United States Patent [19]

Westphal

[11] 4,258,859

[45] Mar. 31, 1981

[54] NO-FIN SCORED METAL ENDS FOR CONTAINERS

[75] Inventor: Teddy M. Westphal, Glencoe, Mo.

[73] Assignee: Boise Cascade Corporation, Boise, Id.

[21] Appl. No.: 126,442

[22] Filed: Mar. 3, 1980

Related U.S. Application Data

[62] Division of Ser. No. 9,188, Feb. 2, 1979, Pat. No. 4,216,736.

[51] Int. Cl.[3] ..... B65D 41/32

[52] U.S. Cl. ..... 220/270; 220/266; 220/268

[58] Field of Search ..... 220/266–273; 113/121 C, 1 F, 15 A

[56] References Cited

U.S. PATENT DOCUMENTS

| | | | |
|---|---|---|---|
| 3,693,827 | 9/1972 | Baumeyer et al. | 220/270 |
| 3,898,944 | 8/1975 | Holk, Jr. et al. | 113/1 F |
| 3,946,683 | 3/1976 | Jordan | 113/15 A |
| 3,951,084 | 4/1976 | Cookson | 113/121 C |
| 3,964,414 | 6/1976 | Gane | 113/121 C |
| 4,003,494 | 1/1977 | Smith et al. | 220/268 |

*Primary Examiner*—George T. Hall
*Attorney, Agent, or Firm*—Laubscher & Laubscher

[57] ABSTRACT

An improved scored metal end closure member for composite containers and the like is disclosed, together with the method and apparatus for forming the same, characterized in that a fully or partially removable panel portion is defined in the central panel portion by a scoreline of novel no-fin configuration. The scoreline—which is formed in one horizontal surface of the central panel portion by a truncated wedge score indenting device—has a generally trapezoidal configuration including a flat bottom wall, and generally divergent side walls. The opposite horizontal surface of the central panel portion is stepped to define a region of reduced thickness that extends from a location opposite one edge of the scoreline bottom wall in a direction away from the scoreline. Consequently, during progressive removal of the removable panel portion, the formation of sharp fins or projections on the residual lip remaining on the metal end is avoided. The scoreline may be formed in either the upper surface or the lower surface of the central panel portion of the metal end, and the stepped relieved portion may extend radially outwardly from a point opposite the juncture between the scoreline bottom and outer side walls, or radially inwardly from a point opposite the juncture between the scoreline bottom and inner side walls.

7 Claims, 9 Drawing Figures

Fig. 1
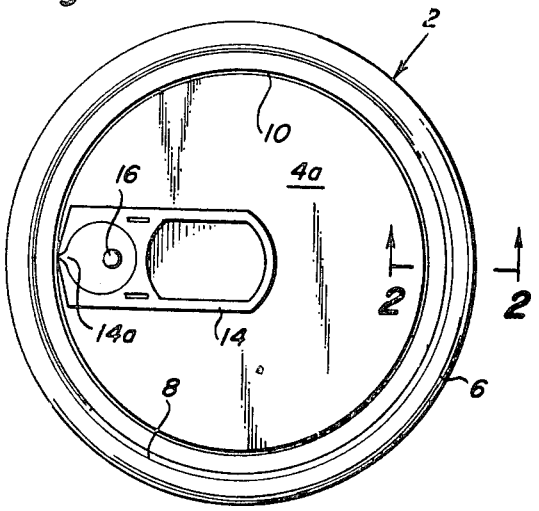
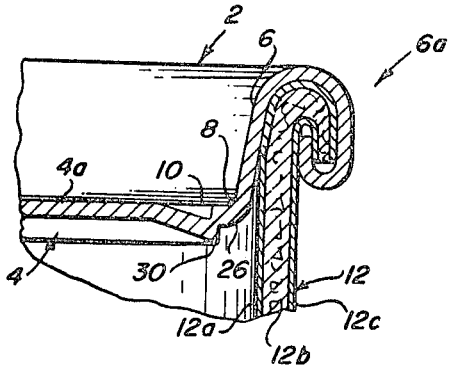
Fig. 2
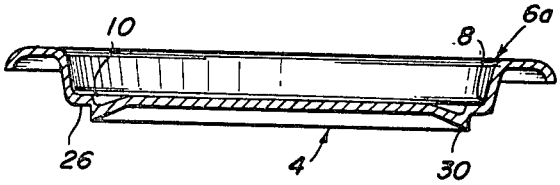
Fig. 4
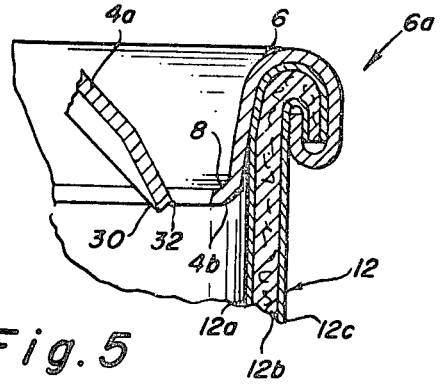
Fig. 5
Fig. 3
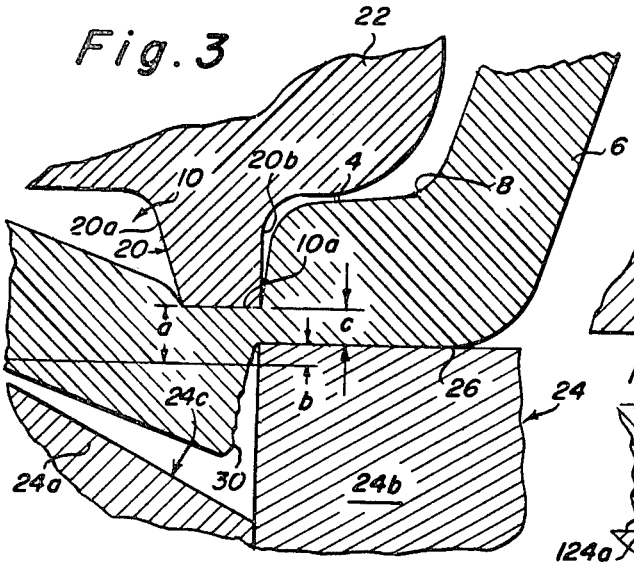
Fig. 6
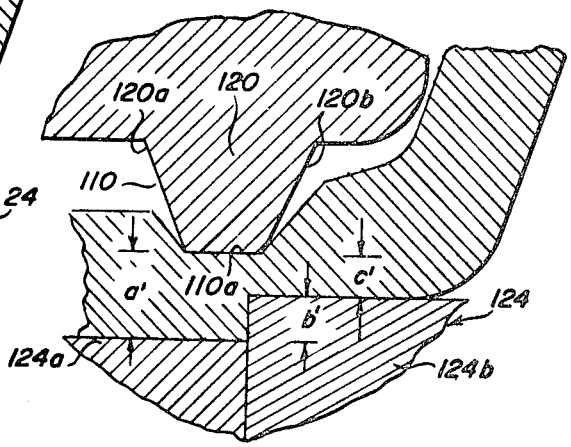

Fig. 5A
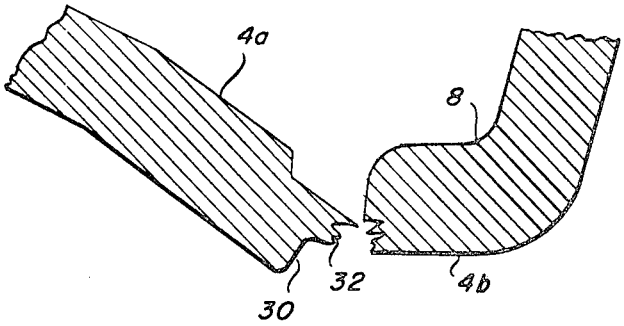
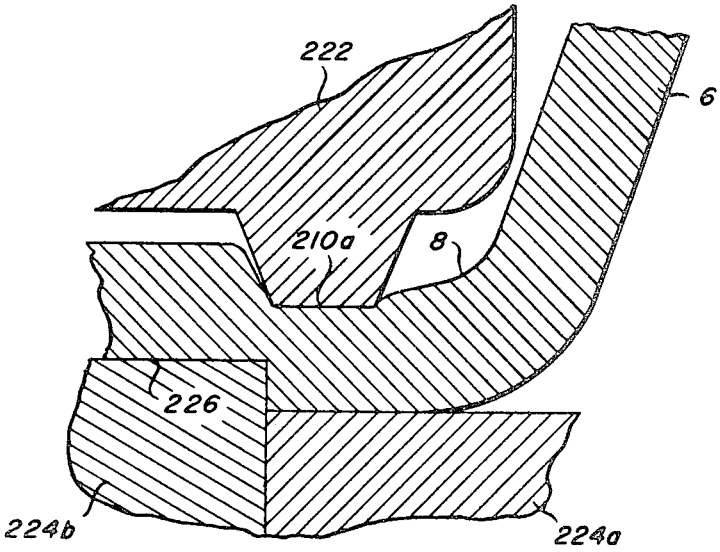
Fig. 7
Fig. 8
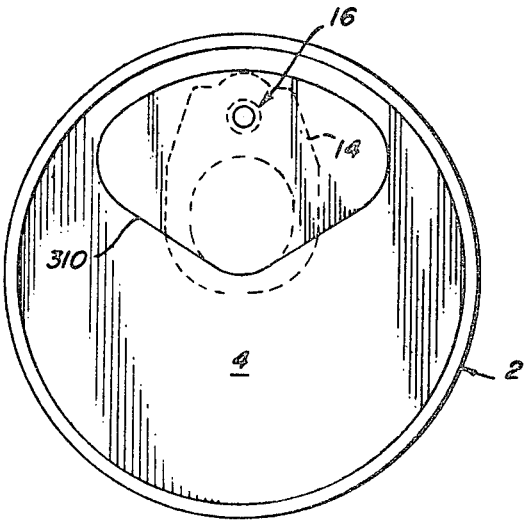

NO-FIN SCORED METAL ENDS FOR CONTAINERS

This is a division of application Ser. No. 9,188, filed Feb. 2, 1979, now U.S. Pat. No. 4,216,736.

BRIEF DESCRIPTION OF THE PRIOR ART

It is well known in the patented prior art to form a scoreline in a metal end closure member to define a fully or partially removable panel within the central panel of the metal end, as disclosed, for example, by the patents to Schane U.S. Pat. No. 3,891,116, Cookson U.S. Pat. No. 3,951,084 and Hekal et al U.S. Pat. No. 3,765,561, among others.

One inherent drawback to such containers is the formation of dangerous sharp fins or projections on the residual lip portion which remains on the metal end following removal of the removable panel portion. Various solutions have been proposed for protecting the user against sharp edges or projections on the residual lip, such as a protective layer of hot melt (as evidenced by the patents to Ellerbrock et al U.S. Pat. No. 4,016,311, Bartels U.S. Pat. No. 3,744,668 and Fox et al U.S. Pat. No. 3,754,678, for example), or by overlying or underlying protective bands (as disclosed, for example, by the patents to Hekal et al U.S. Pat. No. 3,765,561, Pound et al U.S. Pat. No. 3,463,348, Stec U.S. Pat. No. 3,447,713 and Colby et al U.S. Pat. No. 3,527,377). It has, moreover, been proposed to provide protective ribs on the wall of the container body, as evidenced by the patents to Koboldt et al U.S. Pat. No. 3,599,540 and Punte U.S. Pat. No. 2,383,274.

Consideration has been given in the prior art to the specific configuration of the scorelines and to methods and apparatus for forming the same, as evidenced by the patents to Jasper U.S. Pat. No. 3,406,866, Schrecker U.S. Pat. No. 3,688,718, Kinkel U.S. Pat. No. 3,701,330, Brown U.S. Pat. No. 3,870,001, Zundel U.S. Pat. No. 3,875,884, Holk et al U.S. Pat. No. 3,898,944, Urmston U.S. Pat. No. 3,938,455, Jordon U.S. Pat. No. 3,946,683, Cookson U.S. Pat. No. 3,951,084, Herbst et al U.S. Pat. No. 3,970,023 and Lovell et al U.S. Pat. No. 4,006,700.

SUMMARY OF THE INVENTION

The present invention was developed to provide an improved scoreline configuration for full or partial opening metal end closure members for composite containers and the like, wherein the scoreline is so designed that the formation of undesirable metal fins or sharp projections on the residual lip portion upon full or partial removal of the removable panel portion is avoided.

Accordingly, a primary object of the present invention is to provide a metal end closure member containing in one horizontal surface of the central panel portion a scoreline which defines a wholly or partially removable panel portion, said scoreline having a generally trapezoidal cross-sectional configuration with a horizontal generally flat bottom wall, and a pair of generally divergent side walls, the opposite horizontal surface of the central panel portion being stepped to define a portion of reduced thickness defining a relieved horizontal surface that extends from a point opposite a juncture between the scoreline bottom and side walls away from the scoreline. Consequently, the distance between the scoreline bottom wall and the plane containing the other horizontal surface of the central panel portion is greater than the distance between the scoreline bottom wall and the horizontal relieved surface.

According to a more specific object, the scoreline may be formed in either the upper or the lower horizontal surface of the central panel portion. Furthermore, the relieved stepped portion may extend radially outwardly from a point opposite the juncture between the scoreline bottom and outer side walls, or radially inwardly from a point opposite the juncture between the scoreline bottom and inner side walls. The scoreline may be continuous (circular or non-circular) for defining a full-panel or part-panel removable section (such as a one-third panel section, for example), or discontinuous for forming a partially removable panel section (such as an opening arrangement in which the tab opener produces partial but not total removal of the section from the central panel portion of the metal end).

A further object of the invention is to provide a method and apparatus for forming the specific scoreline configuration and the stepped portion of reduced thickness in opposite surfaces of the metal end, respectively. More particularly, one horizontal surface of the central panel is supported on an anvil member, and the scoreline is formed by a circular truncated wedge score indentation means. The stepped portion is simultaneously formed in the opposite surface of the central panel portion by a raised portion of the anvil means, said raised portion having a flat upper end surface that is spaced from another portion of the anvil by a distance which is less than that between the scoreline bottom wall and the opposite surface of the central panel portion. In the case of a circular scoreline, the raised anvil portion is annular and has an inner diameter that equals the diameter of the outer peripheral edge of the scoreline bottom wall, whereby the distance between said scoreline bottom wall outer peripheral edge and the relieved horizontal wall is less than the distance between the scoreline bottom wall inner peripheral edge and the opposite horizontal surface of the central panel portion. In the latter case, if desired, the outer upper edge portion of the cylindrical central portion of the anvil may be relieved to define an annular space which receives a portion of the metal end deformed during the formation of the scoreline and the stepped portion. Preferably, the outer wall surface of the score wedge means is generally vertical, the inner wall surface being inwardly inclined in the downward direction.

BRIEF DESCRIPTION OF THE DRAWING

Other objects and advantages of the invention will become apparent from a study of the following specification when viewed in the light of the accompanying drawing, in which:

FIG. 1 is a top plan view of the scored metal end of the present invention secured to a composite container body;

FIG. 2 is a sectional view taken along line 2—2 of FIG. 1;

FIG. 3 is a detailed sectional view of the scoreline forming means of the present invention;

FIG. 4 is a sectional view of the scored metal end blank;

FIG. 5 illustrates the manner of opening the metal end of FIGS. 1 and 2, wherein the formation of fins or sharp projections on the residual lip is avoided;

FIG. 5A is an enlarged detailed view of the scoreline fracture of FIG. 5;

FIG. 6 is a detailed sectional view of a modification of the apparatus of FIG. 3;

FIG. 7 is a detailed sectional view of a modification of the apparatus of FIG. 6, wherein the stepped relieved portion extends radially inwardly from a point opposite the juncture between the scoreline bottom and inner side walls; and FIG. 8 is a top plan view of a metal end provided with a scoreline which defines a one-third opening panel.

DETAILED DESCRIPTION

Referring first more particularly to FIGS. 1 and 2, the metal end closure member 2 is of conventional construction and includes a central panel portion 4 that is joined with the annular chuckwall portion 6 by a curved radius portion 8. Contained in the upper horizontal surface of the central panel portion adjacent and concentrically with the radius portion 8 is a circular scoreline 10 which defines in the central panel portion the removable panel portion 4*a*. As is conventional in the art, the chuckwall portion terminates at its upper end in a flange portion 6*a* which is adapted for connection with one end of the container body 12 (for example, by the illustrated reversely curled rolled seam connection). In the illustrated embodiment, the container body is of the composite type including an impervious metal foil liner layer 12*a*, a fibrous body wall layer 12*b*, and an outer label layer 12*c* (of foil and/or paper, for example). As is conventional in the art, the end closure member includes an opening tab 14 connected with the removable panel portion 4*a* by an integral rivet 16, said opening tab having a sharp puncturing edge 14*a* arranged above a point on the circular scoreline 10.

Referring now to FIG. 3, the circular scoreline 10 is formed in the upper surface of the central panel portion 4 by circular truncated wedge score indenting means 20 integral with the upper scoring die member 22, the metal end being supported on lower anvil means 24. The inner peripheral wall 20*a* of the wedge score indenting means converges inwardly in the downward direction, and the outer peripheral wall 20*b* is generally vertical, whereby the resulting circular scoreline 10 has a generally trapezoidal configuration with a generally horizontal flat bottom wall 10 that is spaced from the bottom surface of the central panel portion by a given distance "a" (on the order of 0.0055 inches). Thus, the scoreline side walls generally diverge outwardly from the bottom wall relative to each other.

The illustrated lower anvil means 24 includes a cylindrical inner member 24*a* having a flat horizontal upper surface, and an annular outer member 24*b* having a flat horizontal upper surface that is spaced at a higher elevation than that of the cylindrical central member by a spacing distance "b" (on the order of 0.002 to 0.003 inches) which is less than said given distance "a"). The inner diameter of the outer annular member 24*b* generally equals that of the outer peripheral edge of the scoreline bottom wall 10, whereby an annular stepped portion of reduced thickness is formed in the bottom surface of the central panel portion defining a relieved horizontal surface 26 that extends radially outwardly from a circular line directly opposite the outer peripheral edge of the scoreline bottom wall, the relieved surface 26 continuing beneath the radius portion 8. Thus, the distance "c" between the outer peripheral edge of the scoreline bottom wall 10*a* and the horizontal relieved surface 26—which is on the order of 0.0025 inches—is less than said given distance "a".

As shown in FIG. 3, the upper peripheral edge portion of the cylindrical central anvil member 24*a* is relieved by the chamfered surface 24*c* to define an annular chamber that receives by deformation a portion of the metal of the central panel portion during the formation of the scoreline 10 and stepped relieved surface 26. Thus, an annular downwardly depending rib 30 is formed on the bottom surface of the central panel portion directly beneath the bottom wall of the scoreline 10.

To open the container of FIGS. 1 and 2, the opening tab 14 is pivoted upwardly relative to the pivot 16 to cause the pointed tab end 14*a* to puncture the scoreline 10, whereupon the tab is pulled to remove—either fully or partially by shearing or tearing—the removable panel portion 4*a* from the central panel portion 4. As shown in FIG. 5, owing to the specific scoreline and stepped surface arrangement of the present invention, the sharp fins or projections 32 formed during the tearing of the removable panel portion from the metal end are carried solely by the removable panel portion, whereby the residual lip portion 4*b* is completely free of these dangerous fins or projections. Thus, the line of fracture upon removal of the removable portion extends between the outer peripheral edge of the scoreline bottom wall and the inner peripheral edge of the horizontal annular relieved surface 26 formed in the bottom of the central panel portion.

While in FIG. 3 the cylindrical inner and annular outer anvil members have been illustrated as being separate concentrically arranged elements, it is apparent that these anvil members could be formed as a single integral member, if desired. Furthermore, while the score die and anvil means have been illustrated for forming a continuous circular scoreline and a corresponding annular stepped relieved portion in the opposing surface, whereby a full-panel completely removed section is defined, these components could be arranged to provide a scoreline that is not continuous (for a partially removable opening device), or a scoreline that is not circular. Moreover, in accordance with the inventive concepts, the arrangement of the parts could be reversed so that the scoreline is formed in the lower horizontal surface, the upper surface of the central panel portion being stepped.

Referring now to the modification of FIG. 6, the side walls 120*a* and 120*b* of the wedge score indentator means 120 converge downwardly toward a horizontal scoreline bottom wall, thereby forming a circular scoreline 110 of corresponding generally trapezoidal cross-sectional configuration having a generally flat horizontal bottom wall 110*a*. Furthermore in this embodiment, the upper outer peripheral edge portion of the cylindrical inner anvil member 124*a* is not relieved to define a chamber for receiving the metal deformed from the central panel portion during the scoring and stepping operation, but rather the entire upper end surface of the cylindrical inner anvil member is horizontal, flat and continuous throughout its radial dimension.

In the modification of FIG. 7, the relieved surface 226 extends radially inwardly from a circular line opposite the juncture between the scoreline bottom wall 210*a* and the scoreline inner side wall. The fracture of the central panel portion is achieved in the same no-fin manner as that of FIGS. 5 and 5A. While in FIGS. 1–7 the scoreline and relieved portions have been illustrated and described as being in the upper and lower surfaces of the central panel portion, respectively, it is apparent that the scoreline could be formed in the lower surface and the relieved portion in the upper surface, if desired.

As shown in FIG. 8, the scoreline 310 may define removable panel sections of different size and configuration within the central panel portion, such as the illustrated one-third opening section. Moreover, instead of being continuous for defining a fully removable section, the scoreline might be discontinuous (i.e., U-shaped, for example) for defining a section which is partially but not totally removed from the central panel portion, whereby the production of undesirable litter is avoided.

While in accordance with the provisions of the Patent Statutes the preferred forms and embodiments of the invention have been illustrated and described, it will be apparent to those skilled in the art that changes and modifications may be made without departing from the inventive concepts set forth above.

What is claimed is:

1. A unitary metal end closure member for composite containers and the like, comprising (a) a horizontal generally disk-shaped central panel portion;

(b) an annular upwardly extending chuckwall portion connected at its lower end with the peripheral edge of said central panel portion by a curved radius portion, the upper end of said chuckwall portion being adapted for connection with the upper end of a container body;

(c) one horizontal surface of said central panel portion containing a scoreline for defining at least a partially removable panel section, said scoreline having in traverse cross-section a generally trapezoidal cross-section including (1) a flat generally horizontal bottom wall; and (2) a pair of generally divergent side walls;

(d) the other horizontal surface of said central panel portion being stepped to define a region of reduced thickness defining a horizontal relieved surface extending from a location opposite the juncture between one scoreline side wall and the scoreline bottom wall in a direction away from the scoreline, whereby the distance between the scoreline bottom wall and the plane containing said other horizontal surface is greater than the distance between said scoreline bottom wall and said horizontal relieved surface, so that upon progressive removal of said removable panel portion from said central panel portion, the formation of undesirable sharp metal fins or projections on the residual portion of the metal end is avoided.

2. A metal end closure member as defined in claim 1, wherein said one horizontal surface comprises the upper surface of said central panel portion.

3. A metal end closure member as defined in claim 1, wherein said one horizontal surface comprises the bottom surface of said central panel portion.

4. A metal end closure member as defined in claim 1, wherein said stepped relieved surface extends outwardly from the scoreline from a point generally opposite the juncture between the bottom and outer side walls of the scoreline.

5. A metal end closure member as defined in claim 1, wherein said stepped relieved surface extends inwardly from the scoreline from a point generally opposite the juncture between the bottom and inner side walls of the scoreline.

6. Metal end closure means as defined in claim 1, and further including opening tab means connected with said removable panel section for initially effecting puncturing of said central panel portion at a point on the scoreline, said tab means being subsequently operable to at least partially tear said removable panel section from said central panel portion along said scoreline.

7. Metal end closure means as defined in claim 6, wherein said scoreline is continuous and defines a fully removable section within said central panel portion.

* * * * *